US005924576A

United States Patent [19]

Steenge

[11] Patent Number: 5,924,576

[45] Date of Patent: Jul. 20, 1999

[54] METHOD FOR SORTING ITEMS OF MAIL IN ORDER OF DELIVERY

[75] Inventor: Tijs Wiebe Steenge, The Hague, Netherlands

[73] Assignee: Koninklijke PTT Nederland N.V., Netherlands

[21] Appl. No.: 08/854,084

[22] Filed: May 9, 1997

[30] Foreign Application Priority Data

May 17, 1996 [NL] Netherlands ..... 1003154

[51] Int. Cl.[6] ..... B07C 5/02

[52] U.S. Cl. ..... 209/584; 209/900; 271/3.14

[58] Field of Search ..... 209/552, 559, 209/583, 584, 900; 271/3.14, 3.15, 4.01

[56] References Cited

U.S. PATENT DOCUMENTS 5,009,321 4/1991 Keough .
5,353,938 10/1994 LaGrange et al. .

FOREIGN PATENT DOCUMENTS 0 533 536 3/1993 European Pat. Off. .
575032 12/1993 European Pat. Off. ..... 209/584
0 684 086 11/1995 European Pat. Off. .

*Primary Examiner*—Tuan N. Nguyen
*Attorney, Agent, or Firm*—Michaelson & Wallace; Peter L. Michaelson

[57] ABSTRACT

A method for sorting items of mail according to the sequence of delivery points in delivery runs. The sorting process takes place in a number of successive sorting operations, sorting runs. Sorting takes place according to sequence number of the delivery points within the delivery runs during the last sorting run but one, and according to delivery run during the last sorting run. During said last sorting run, a suitable number of sections of a sorting apparatus have been reserved for each delivery run, and each delivery run is subdivided into as many segments, e.g. four. The items of mail for the first segment of a delivery run, in the example for the first quarter of the sequence numbers, are deposited in the first of the sections reserved for said delivery run, those for the second segment in the second section, and so forth. Upon completion, the items of mail for a delivery run are collected by placing the delivery segments in succession.

19 Claims, 2 Drawing Sheets

METHOD FOR SORTING ITEMS OF MAIL IN ORDER OF DELIVERY

A. BACKGROUND OF THE INVENTION

The invention relates to a method for sorting items of mail destined for addresses/delivery points within a predefined delivery area into a delivery sequence by means of a sorting arrangement comprising:

- an input for the purpose of feeding into the arrangement successive items of mail carrying address information;
- a reading device for the purpose of reading the address information on the items of mail fed into the arrangement;
- a control device for the purpose of analyzing the address information retrieved from the items of mail and allocating a sequence indication to the item of mail in question;
- a number of similar deposit devices, numbered 1, 2, . . . , n in sequence, in which to deposit the items of mail, said method comprising:

(a) a first sorting run in which:
- items of mail are fed into an input;
- the reading device reads the address information on the items of mail;
- the control device, on the basis of the retrieved address information, allocates a sequence indication to each item of mail, and
- each item of mail is deposited in a deposit device with a first sequence number derived from the sequence indication allocated to the item of mail in question;

(b) a second sorting run in which:
- the items of mail deposited during the first sorting run are taken from the successive deposit devices with sequence numbers 1 . . . n and again fed into an input of the arrangement, and
- each item of mail is again deposited in a deposit device with a second sequence number, derived from the sequence indication allocated to the item of mail in question;

(c) a bundling stage in which the items of mail from the successive deposit devices are bundled while retaining the order in which they were deposited in each deposit device.

In the description of the method a number of terms will be used, with the following definitions in this context.

Mail processing comprises the collection of items of mail from various senders, sorting according to destination, transport, and distribution by postmen around delivery points of addressees, such as home addresses.

A delivery area is defined as a geographically delineated section of the operating area of a mail-processing organization, said delivery area generally being subdivided into a number of delivery runs. When in a certain delivery area sorting into delivery sequence takes place, this occurs for the items of mail destined for the organization's own delivery area; in the delivery area in question, the items of mail for other delivery areas will be sorted according to different delivery areas only, and they will only be sorted according to delivery sequence once they have reached those other delivery areas.

A delivery run is defined as a predetermined, most suitable, postman's walk along a given number of delivery points, e.g. home addresses, for items of mail in a section of a delivery area. The number of delivery points included in a certain delivery run, and the route followed by the postman in question to deliver the items of mail destined for that run, have been chosen so as to enable delivery along the entire route to take place at least once per day. As a matter of fact, whenever the text refers to walking, any other means of locomotion (e.g. bicycle or motorcar) may apply.

A sorted delivery run is defined as a collection of items of mail, destined for delivery points within the relevant delivery run, sorted according to the sequence of the delivery points along the postman's walk of the delivery run.

A sorted delivery run may have been subdivided during the sorting process into a number of sections with equal numbers of delivery points, in which the sections, placed in consecutive order, result in the sorted delivery run. Each of the sections, hereinafter referred to as delivery segments, may include one or more dummy delivery points at which no item of mail will ever have to be delivered. Said dummy delivery points may for example serve to make up a suitable number of delivery points in a delivery segment.

A method for sorting items of mail in sequence is disclosed in U.S. Pat. No. 5,009,321.

In the method according to said prior-art technique, the number of items of mail to be sorted is first sorted according to delivery run; U.S. Pat. No. 5,009,321 describes how this is followed by a sorting process for each delivery run, with the result that the delivery run is broken up into as many sections, delivery segments, as there are stackers in the sorting arrangement used. Upon completion of the sorting process, in which the items of mail for a certain delivery run are processed into a number of successive sorting runs, the items of the first delivery segment are in the first stacker, in the order in which they were deposited, the items of the second delivery segment are in the second stacker, and so forth. Said method uses a relatively small number of sorting arrangements, with a limited number of stackers; a number of 20 is mentioned. It is assumed that the items of mail will have been presorted according to delivery run, so each time, the items for a single delivery run can be fed into such a relatively small sorting arrangement. If larger numbers of items of mail need to be processed in a certain location, this requires, if the sorting process described is to be adhered to, a (large) number of such small arrangements, and the transport to, from, and between the arrangements will become a bottleneck preventing an efficient process. If larger sorting arrangements are used, which in this context means with a larger number of stackers or other deposit devices, the sorting process according to the prior-art technique cannot be used as it is. This is because the prior-art method does not provide the means of efficient use of such larger sorting arrangements, as too much time would be involved with collecting the items of mail for a delivery run from the larger number of deposit devices, and the risk of errors made by the operators as a result of the complexity of the sorting process would be relatively large. In addition, as a result of the fact that sorting into a delivery run must first take place before sorting according to delivery point can take place, the number of sorting runs forms an obstacle. Finally, there is the drawback that the number of delivery points per delivery run is more or less fixed, as smaller numbers render the prior-art method less efficient, whereas the number is limited when using a sorting arrangement with the proposed small number of deposit devices.

Even so, larger sorting arrangements can be provided with deposit devices other than stackers, such as bins that can be placed into the arrangement and subsequently removed, in which the items of mail are posited after sorting.

B. SUMMARY OF THE INVENTION

The object of a method according to the invention is to overcome the drawbacks outlined above, i.e. to enable a sorting arrangement with a large number of deposit devices to be used for sorting items of mail for several delivery runs simultaneously, while the number of deposit devices from which the items of mail must be collected for a certain delivery run upon completion of the sorting process remains limited, as does the number of sorting runs. In fact, the method according to the invention combines the presorting of items of mail according to delivery run with the sorting according to delivery point sequence within the delivery runs, thus obviating the need for separate presorting per delivery run. In other words, mail for a deliver area comprising a number of delivery runs can be supplied unsorted. For this purpose, a method according to the invention is characterized in that:

the delivery area comprises a number (≧2) of delivery runs;

the indication of sequence allocated by the control device during the first sorting run represents a pair of numbers (j,k), with a first number j=1, 2, . . . , n and a second number k=1, 2, . . . , n, the allocated number pairs forming matrix positions within an (n×n) matrix, each matrix position corresponding with a delivery point within a delivery run in the delivery area, and the matrix positions being grouped per delivery run into non-overlapping (p×q) submatrices of the (n×n) matrix;

during the first and second sorting runs, each item of mail is deposited in a deposit device with a sequence number in accordance with the first number, respectively the second number, of the allocated number pair, and during the bundling stage, for a certain delivery run, the items of mail from the deposit devices with the sequence numbers in accordance with the numbers k corresponding to that delivery run are bundled in succession, in the order of said numbers, in a manner such that during the first sorting operation, the items of mail for a number of delivery runs, said number being at least equal to two, are sorted, and that during the second sorting operation, per delivery run i with p×q delivery points, q of the n deposit devices of the sorting arrangement are used (n>q>1) in a manner such that the items of mail for the first p delivery points of the delivery run, forming the first delivery segment of the delivery run, are deposited in the first of the q deposit devices in delivery point sequence, the items of mail for the second p delivery points, forming the second delivery segment of the delivery run, in the second of the q deposit devices, in delivery point sequence, and so on until the items of mail for all p×q delivery points of delivery run i have been deposited in their allocated deposit devices.

According to a preferred embodiment of the invention, the method is characterized in that for the number of segments, q, for a certain delivery run a value is chosen depending on the number of delivery points of that delivery run. This has the benefit that the sorting process can be optimized at any moment for any sorting arrangement available at the time. In other words, in a sorting process according to the invention any sorting arrangement can be used, independent of its size and capacity.

According to a further preferred embodiment of the invention, the deposit devices comprise stackers in the sorting arrangement and at least one dummy delivery point is added to the delivery points of each delivery segment, for which delivery point no items of mail are ever deposited in a stacker. The reaching of the first dummy delivery point during the sorting process can be followed by a 'segment completed' signal suitable for human perception, e.g. an auditory or visual signal. This makes it possible to give the operators the opportunity to collect the items of mail for a delivery run from the adjoining q stackers, without the need for separating cards or similar means. As a matter of fact, the use of separating cards would result in severe complications as provisions would have to be made in or on the sorting arrangement for inserting separating cards at the relevant moments. As a result, the method for sorting according to delivery point sequence could no longer be used without alterations on any sorting arrangement. In various preferred embodiments, the 'segment completed' signal is terminated through intervention by the operators, e.g. by operating a push button after emptying the relevant stackers, or terminated as a result of 'stacker empty' signals generated within the sorting arrangement. In both cases, a signal is given that the relevant q stackers can be used for sorting a subsequent delivery run.

C. REFERENCE

U.S. Pat. No. 5,009,321 Sorting system for organizing randomly ordered route grouped mail in delivery order sequence.

D. SHORT DESCRIPTION OF THE DRAWING

The drawing will be explained in greater detail by means of a description of an exemplary embodiment, with reference to a drawing, in which.

E. DESCRIPTION OF AN EXEMPLARY EMBODIMENT

The aim of letter mail processing is to sort and transport the mail in a manner such that it becomes available to the postman in time and in the order of delivery. In general, only part of the process is automated; this involves in particular mail of standard dimensions, and even then, sorting only takes place to delivery run level. To increase the efficiency of the processing operation, a higher level of automation is aimed at. This encompasses methods for mechanized sorting according to sequence within a delivery run. In existing systems for mail processing, the available address information, such as the postal code shown on the item of mail and the house number which is also shown on the item of mail, is used to derive an identification code which is printed in a suitable location on the item of mail in question in a form easily readable to machines. Such an identification code contains sufficient information to determine the corresponding delivery point within a delivery run for each item of mail; the identification code can be the sequence number of the delivery point, or the code can form a reference to a set of data in the memory of a computer for the purpose of determining the sequence number from the code at appropriate moments. In principle, a full sorting operation down to walk sequence could be executed in this manner. The method according to the invention makes it possible to execute such a sorting operation according to walk sequence with the use of relatively large sorting arrangements, for example with 200 stackers, and without the need for previous sorting according to delivery run.

Figure 1:
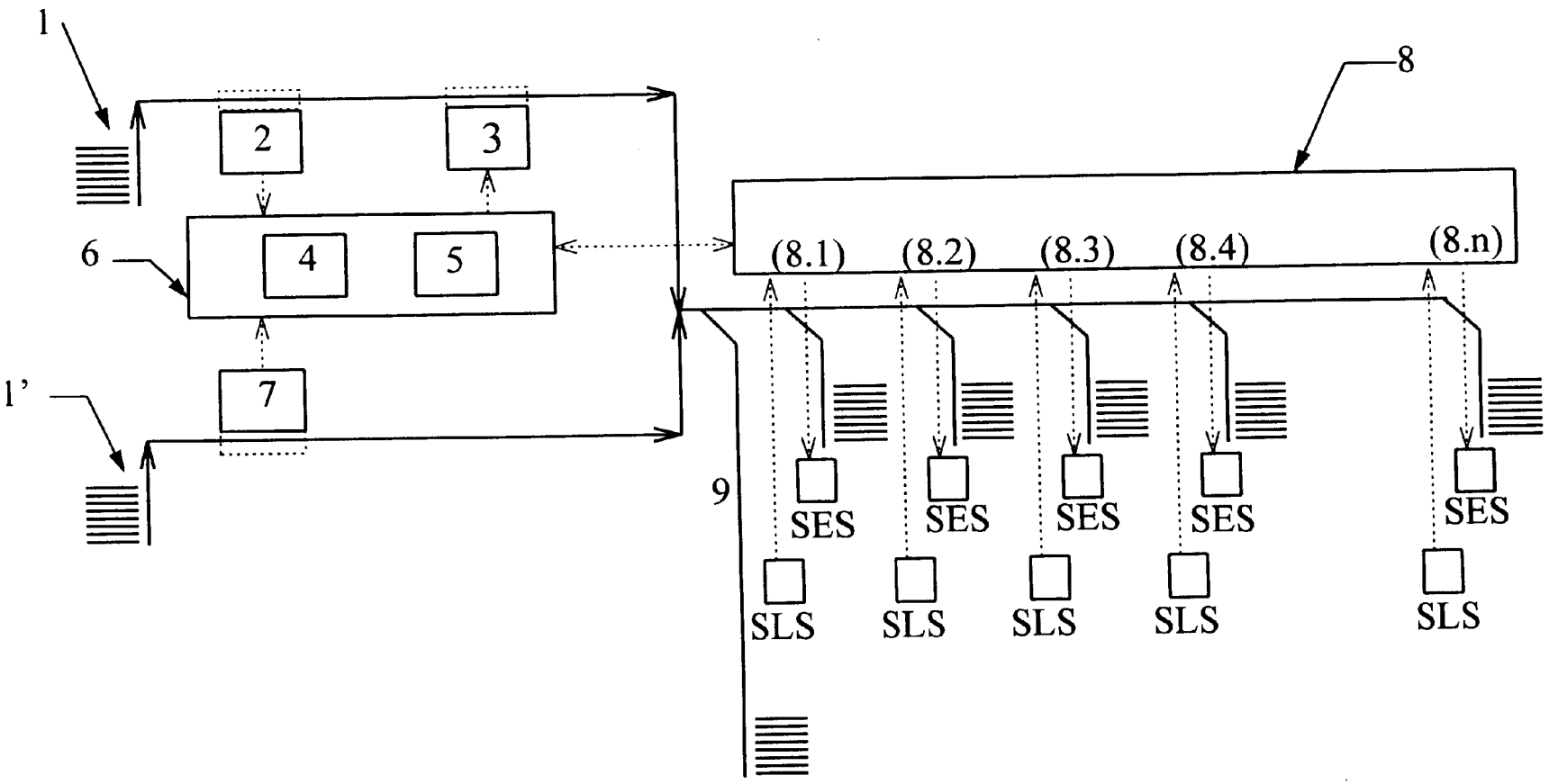
FIG. 1 is a schematic representation of a sorting arrangement, in which the method according to the invention is applied.

FIG. 1 is a schematic representation of a sorting arrangement, in which the method according to the invention is applied. The sorting arrangement comprises:

- inputs (1) and (1'), through which items of mail are fed into the arrangement;
- reading devices (2) and (7) for the purpose of reading destination information (in general, addresses, or codes derived from the addresses, which are easily readable to machines) on items of mail passing by;
- a printing device (3) for the purpose of applying machine readable codes onto items of mail;
- a control device (6) with a central processing unit (4) and memory devices (5);
- a depositing arrangement (8) with n similar deposit devices, e.g. stackers, (8.1) up to and including (8.n);
- an output (9) for items of mail that cannot be sorted in the sorting run in question.

The components referred to are found in prior-art sorting arrangements. For the purpose of using the method according to the invention, each stacker is in addition fitted with an indicator SCS, e.g. a lamp, and a signalling device SLS, e.g. a push button or some other switching device. The role played by SES and SLS in the method according to the invention is explained in the description of FIG. 2.

During an initialization phase, items of mail are fed into an input (1) of the sorting arrangement, and transported past a reading arrangement (2), in which destination information is derived from the items of mail, and past a printing arrangement (3), in which a code (e.g. a bar code) corresponding with the destination information is applied to the items of mail. The destination information is fed into a control device (6) with central processing unit (4) and memory devices (5). Depending on the destination information and controlled by the control device (6), each item of mail is deposited during a first sorting operation into one of the n stackers, (8.1) up to and including (8.n), of a depositing arrangement (8). Upon completion of the first sorting operation, the contents of the stackers, while maintaining the stacking sequence, (stackers 1 . . . n), are once again fed into an input (1') of the sorting arrangement. In an exemplary embodiment, inputs (1) and (1') may be formed by one and the same feeding device. In the exemplary embodiment according to FIG. 1, during the second sorting operation, the items of mail are once again transported past a reading device, in this case (7), for the purpose of reading the code applied during the first sorting operation. It should be noted that the control device (6) can also be arranged in a manner such that the destination information read and stored in the control device (6) during the first sorting operation is used, obviating the need for a second reading operation. During the second sorting operation, each item of mail is again deposited in one of the n stackers of the depositing arrangement (8), depending on the destination information.

Figure 2:
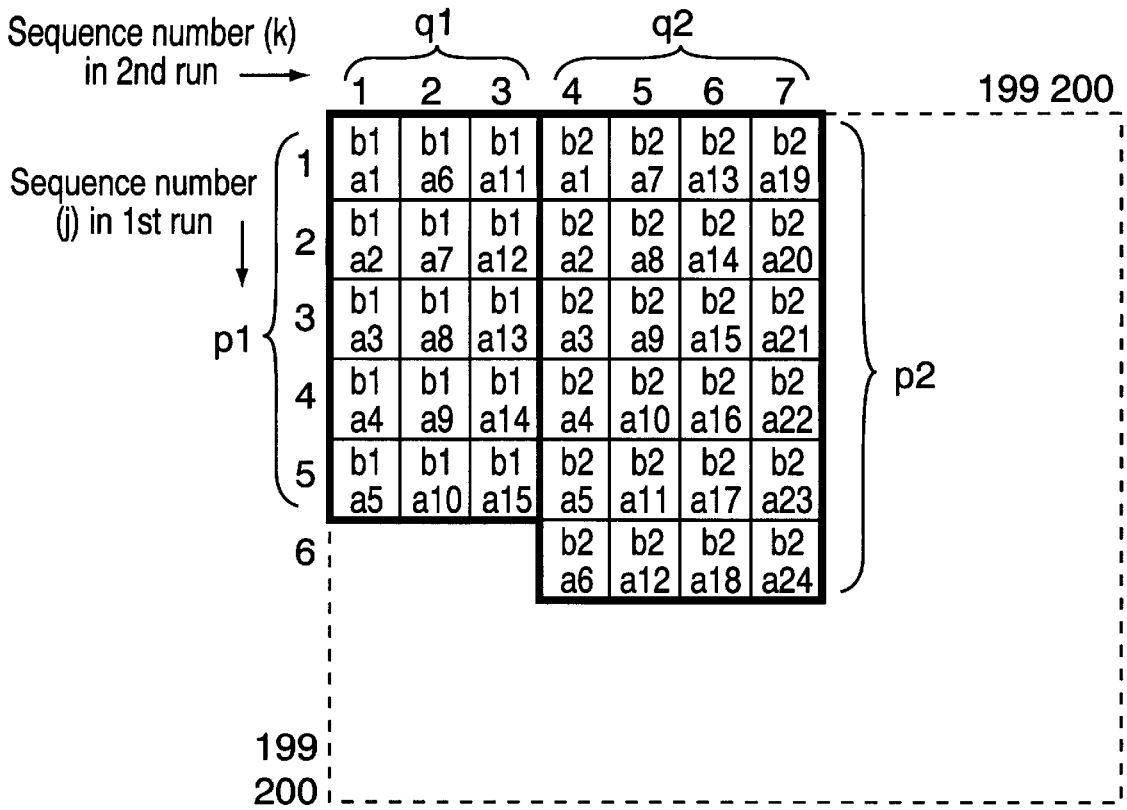
FIG. 2 shows an example of a 2-dimensional table for a sequence sorting operation according to the method of the invention, executed using the sorting arrangement of FIG. 1.

FIG. 2 provides an example of a 2-dimensional table for a sequence sorting operation according to the method of the invention. This is based on the use of a sorting arrangement shown schematically in FIG. 1, with n-=200 deposit devices, e,g, stackers, and a subdivision of each delivery run into a number, q on average, segments, each with the same number of delivery points. This means that during each sorting run, the items of mail for 200/q delivery runs are subjected to a sorting operation, and that the items of mail for a delivery run will be posited in one of the q adjoining stackers. For the number of segments, as will be explained below, a value from 4 to 7 may advantageously be used. The choice of the number of segments per delivery run can be made on the basis of the following considerations. If a relatively large number of segments q is used, upon completion of the sorting operation for a certain delivery run the items of mail for that run will have to be collected from said large number of q stackers in order to arrive at the corresponding end product, all items of mail for that delivery run, in delivery point sequence. This not only has the disadvantage that each time a large number of stackers will have to be emptied, it also limits the number of delivery runs that can be sorted in sequence 'simultaneously'. In the extreme case, when a value for q is chosen that is equal to the number of stackers in the sorting arrangement to be used, i.e. in the case in which a sorting arrangement according to the example to be described is used, the value n=200, the end product for a certain delivery run must be obtained by collecting the items of mail from all 200 stackers. In addition, a relatively long time will pass between the moments at which each subsequent end product becomes available, caused partly by the need for collecting the items of mail for a delivery run before a subsequent delivery run can be started. This hinders a flexible use of the sorting arrangement. If on the other hand, a relatively small number of segments q is chosen, it will take a long time before end products become available. Here, the extreme case is when a value of 1is chosen for q; upon completion of the sorting operation, the items of mail for a certain delivery run will be located in a single stacker and there will be no need to collect them from adjoining stackers. If a sorting arrangement according to the example to be described is used, 200 end products will become available after a relatively long time, but in fairly rapid succession. The rate of succession depends on the extent to which the numbers of delivery points of separate delivery runs vary. Between the extremes of q=n and q=1 there lies an optimum value for the number of segments in which a delivery run should be subdivided. Using computer models based on data about the numbers of items of mail to be processed per day, and about the distribution of the items of mail into various categories (mail from letter boxes in the street or from large-volume customers, desired order of availability of end products etc.), it has been shown that for the Dutch situation, it is advantageous to choose a value of q ranging from 4 to 7.

FIG. 2 shows schematically how the first and second sorting run can progress in an exemplary embodiment of the method according to the invention. As stated previously, a depositing arrangement with 200 sections has been assumed (n=200). In addition, it has been assumed that the items of mail submitted for processing have been presorted in a manner such that the items of mail to be sorted in the first and second sorting run are all intended for delivery runs in the delivery area in question. The exemplary embodiment has been arranged in a manner such that the successive delivery runs have increasing numbers of delivery points. Thus, delivery run 2 has more delivery points than delivery run 1 and will in general take longer to complete. This has the effect that the times at which different delivery runs are completed coincide as little as possible, so that the operators who collect the mail for a completed delivery run each time need only progress a small distance along the depositing arrangement. For purposes of illustration is should be mentioned that, with a number of 200 stackers, the length of the arrangement can be of the order of magnitude of 50 meters.

If n=200, this means that during the first sorting run, the sequence numbers, corresponding with stacker numbers, can have a value of 1 up to and including 200. In addition, this means that during the second sorting run, 200 separate delivery segments can be formed. The result of this is that a maximum of 200×200=40,000 delivery points are accessible. If said number is insufficient, previous to the first and second sorting runs according to the method of the invention a presorting operation must take place. During said presorting operation, the items of mail to be sorted for the delivery area in question are subdivided into groups of (up to) 40,000 delivery points. The items of mail from such a group are then, per group, subjected to the first and second sorting run according to the method of the invention. In other words: the items of mail for the first group of 40,000 delivery points are subjected to the first and second sorting run, together to be referred to as batch 1; subsequently, the items of mail for the second group of 40,000 delivery points (in batch 2) are also subjected to the first and second sorting operation. Another possibility consists of executing the first sorting operation for each of the batches separately, followed by executing the second sorting operation, again for each of the batches. For a number of two batches, this entails:

executing the first sorting operation for batch 1, including collecting the items of mail as an intermediate product of batch 1;

temporarily storing the intermediate product of batch 1;

executing the first sorting operation for batch 2, including collecting the items of mail as an intermediate product of batch 2;

temporarily storing the intermediate product of batch 2;

feeding in the intermediate product of batch 1 and executing the second sorting operation on said intermediate product, including collecting completed delivery runs from the various stackers;

feeding in the intermediate product of batch 2 and executing the second sorting operation on said intermediate product, again including collecting completed delivery runs from the various stackers.

In general, the first and second sorting runs can be executed in m batches, batch 1 up to and including batch m. In this way, a maximum of m×40,000 delivery points can be served. In fact, in said case, in addition to p and q, there is a third parameter: the batch number, ranging from 1 up to and including m.

FIG. 2 uses designations such as 'b1 a1'; the designation according to the given example indicates 'delivery run 1, delivery point 1'. The items of mail for delivery point 1 of delivery run 1 have the sequence number 1 in batch 1 and form part of segment 1. Thus, the items of mail for delivery point 24 of delivery run 2 have sequence number 6 and form part of segment 7.

Figure 3:
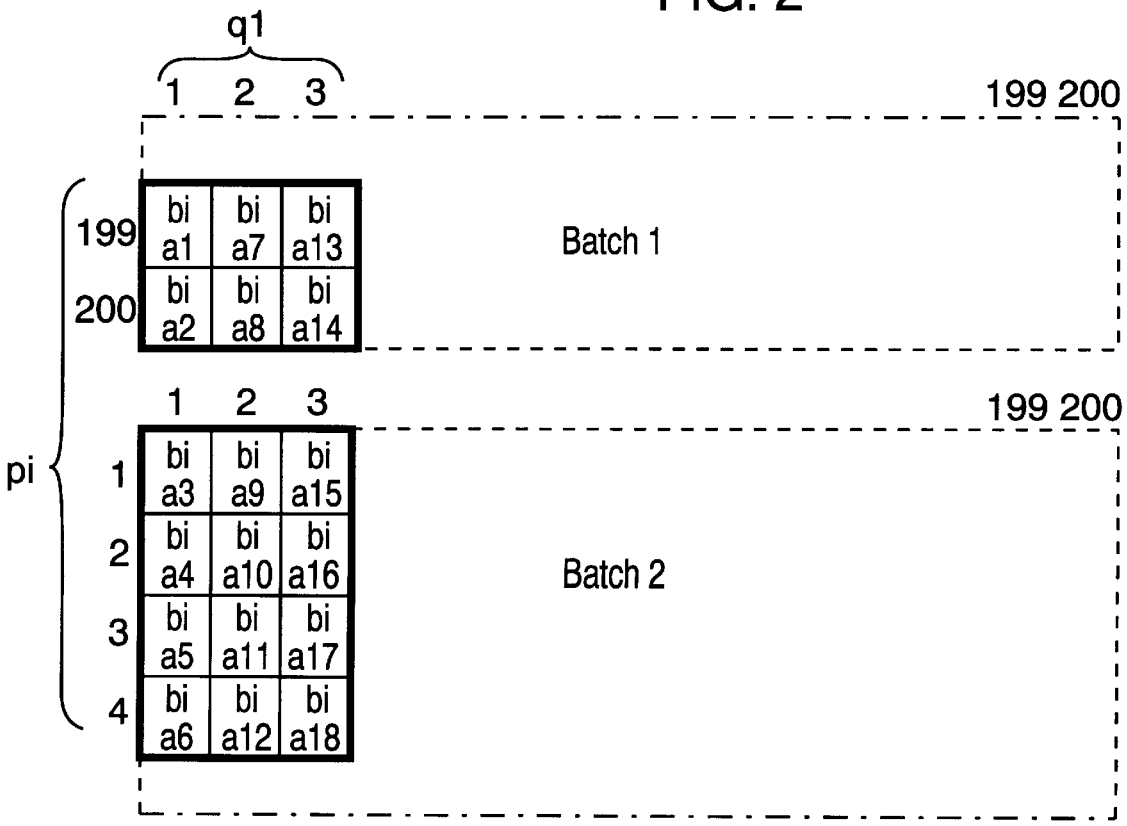
FIG. 3 shows an example of a table for a sequence sorting operation according to the method of the invention, in which the first and second sorting stages are executed in two batches.

FIG. 3 gives an example of a delivery run subdivided into two successive batches: delivery run i, extending through batch 1 and batch 2. The items of mail for delivery point 1 of delivery run i have the sequence number 199 in batch 1 and form part of segment 1; the items for delivery point 18 of the same delivery run have sequence number 4 in batch 2 and form part of segment 3. The dash/dot lines in FIG. 3 indicate that only part of the table applying for batch 1 and batch 2 is shown.

Of course, FIG. 2 and FIG. 3 only provide examples of a distribution of delivery runs and segments among stackers within a depositing arrangement and, as the case may be, different batches. The subdivision can be adapted when alterations to the sorting process are required as a result of changes in delivery runs, for example due to the fact that boundaries between delivery runs need to be shifted as a result of changes in numbers of delivery points in the event of construction or demolition of buildings. When using the method according to the invention, the correlation between the sequence number in a certain batch and segment number on the one hand, and a delivery point in a certain delivery run on the other hand, is recorded in a table; said table is stored in memory devices corresponding with the sorting arrangements to be used. Alterations to the sorting process in the form of changes to the distribution of delivery runs and segments among the sections of a sorting arrangement and batches are effected by altering the relevant table.

In a preferred embodiment of the method according to the invention, in which a sorting arrangement fitted with stackers is used, at least one delivery point at the end of each segment is a dummy delivery point. In the example given in FIG. 2, for delivery run 1 said points are at least the delivery points 5, 10 and 15. The flow of mail will never contain any items of mail for a dummy delivery point. The sorting process can now be arranged in a manner such that when the dummy delivery point (or the first of the dummy delivery points) is reached, the previously mentioned Segment End Signal (SES) is given. Said SES can be an auditory or visual signal. No special equipment is needed to determine that an SES must be generated; the control software forming part of a sorting arrangement provides the means of detecting which sequence number in a certain segment is next in line for processing and thus, the means of determining that the next sequence number in line corresponds with a dummy delivery point. Upon perceiving the SES, the operators of the sorting arrangement in question have the opportunity of emptying the stacker containing the items of mail of the completed segment, and, as the case may be, adding them to previously completed segments of the delivery run in question. Once the stacker has been emptied, the Stacker Empty Signal, SLS, referred to in the discussion of FIG. 1 must be transmitted to the control device of the sorting arrangement to signal that the stacker has indeed been emptied and is ready to receive items of mail for a subsequent delivery run. Said SLS can either be given manually by the operators, e.g. by pressing a switch button, or automatically by a switch located in or near each stacker and operated by the presence or absence of items of mail. The sorting arrangement is preferably stopped when the SLS is not given within a certain predetermined time following the SES while items of mail which are destined for the stacker involved are being fed into the arrangement for processing. The use of dummy delivery points obviates the need for separating cards or other, similar, means of indicating the boundaries between different delivery runs.

In the preferred embodiment which utilizes stackers, attention should be given to the way in which the last segment of a delivery run is distinguished from the first segment of the subsequent delivery run. For example, FIG. 2 involves a separation such as that between the third segment of delivery run 1 and the first segment of delivery run 2, i.e. between column 3 and column 4 in the table. Any one of the following methods could be applied.

1) Between each two successive delivery runs, a dummy stacker is inserted in which no items of mail are deposited during the second sorting operation. This reduces the efficiency of the process, as a number of stackers will remain unused during the second sorting operation.
2) For each batch, a predetermined, fixed stacker order is maintained. This means that, if a number of four segments is chosen for the first delivery run, any subsequent delivery runs in that batch should also consists of four segments. Of course, this has an adverse effect on flexibility.
3) Sorting arrangements are used which are fitted with otherwise known means such as:

a) label holders and means of indicating to the operators which label should be used for a completed delivery run;

b) arrangements for the purpose of printing labels at appropriate moments, which are to be used by the operators for a completed delivery run;

4) To each stacker, in addition to the SES indicator, a second indicator is added which can indicate that the stacker, the second indicator of which gives a signal at a certain moment, at that moment contains a last segment of a delivery run.

In a further preferred embodiment of the method according to the invention, in which bins are used as deposit devices which can be placed in the sorting arrangement and which can be removed from it after having been completely or partly filled, no dummy delivery points need be provided. Upon reaching a segment end, the bin involved is removed from the arrangement, and as long as no empty bin has been replaced, no items of mail will be directed to the deposit device in question.

In the latter preferred embodiment, the use of labels as a simple means of indicating the boundary between delivery runs is obvious.

I claim:

1. A sorting arrangement for sorting into delivery sequence items of mail destined for address/delivery points within a predetermined delivery area having at least two delivery runs, said sorting arrangement comprising:

an input means for successively feeding into said sorting arrangement said items of mail carrying address information;

a reading means for reading said address information on said items of mail;

a control means for analyzing said address information read from said items of mail and for allocating a sequence indication to the items of mail involved; and a number of similar deposit devices with sequence numbers 1, 2, . . . , n for depositing and receiving items of mail therein, said deposit devices comprising stackers in which said items of mail are deposited;

first sorting means for performing a first sorting run for feeding items of mail to said input means, for reading, with said reading means, said address information on said items of mail, for allocating, with said control means, to each said item of mail a sequence indication based on the address information read, wherein each said sequence indication comprises a pair of numbers (j,k), with a first number j=1, 2, . . . , n and a second number k=1, 2, . . . , n, said allocated pairs of numbers forming matrix positions in an (n×n) matrix, each said matrix position corresponding with an address/delivery point in a delivery run within said delivery area, and said matrix positions being grouped per delivery run in non-overlapping (p×q) submatrices of the (n×n) matrix, the number j corresponding with the first number of said allocated pairs of numbers, and for sorting the items of mail for at least two delivery runs during said first sorting run, and for depositing each said item of mail in a deposit device with a first sequence number derived from said sequence indication allocated to the item of mail involved;

second sorting means for performing a second sorting run for taking the items of mail deposited during said first sorting run from said deposit devices with sequence numbers 1, 2, . . . , n, for feeding said items of mail taken from said deposit devices to said input means, and for depositing each said item of mail in a deposit device with a second sequence number derived from the sequence indication allocated to the item of mail involved, wherein said second sequence number corresponds with said second number k of said pairs of numbers, and during each said second sorting run, for each delivery run i with p×q address/delivery points, q of the n deposit devices of said sorting arrangement where (n>q>1) for depositing said items of mail for the first p address/delivery points of the delivery run, forming the first delivery segment of the delivery run, in delivery point sequence in the first of the q deposit devices, and for depositing the items of mail for the second p address/delivery points, forming the second delivery segment of the delivery run, in delivery point sequence in the second of the q deposit devices, and so forth until the items of mail for all p×q are deposited in the deposit devices allocated to them;

bundling means for bundling said items of mail from the successive deposit devices while maintaining the order in which said items of mail were deposited, and for bundling said items of mail of a certain delivery run from said deposit devices in succession according to the numbers k corresponding to the delivery run, in number sequence;

first signal means for generating a segment-end signal suitable for human perception when said first sorting means reaches a first dummy address/delivery point during a delivery run deposit, said first signal means including means for generating said segment-end signal until the corresponding stacker has been emptied, and manual terminating means for enabling manual termination of said segment-end signal after the corresponding stacker has been emptied; and wherein said control means includes means for choosing the value of q, for each delivery run i, as a function of the number of address/delivery points of delivery run i, means for adding, after the last address/delivery point in the sorting sequence of each delivery segment of a delivery run, at least one dummy address/delivery point for which none of said items of mail are ever deposited in any stacker.

2. A sorting arrangement according to claim 1, further including a second signal means for generating a stacker-empty signal and for terminating said segment-end signal in response to the corresponding stacker having been emptied.

3. A sorting arrangement according to claim 1, further including third signal means for generating a not-empty-in-time signal in response to the generation of a segment-end signal within a predetermined time.

4. A sorting arrangement according to claim 1, further including stop means for stopping said sorting arrangement when said not-empty-in-time signal has been generated and said sorting arrangement contains items of mail destined for the group of q corresponding stackers for which said not-empty-in-time signal has been generated.

5. A sorting arrangement for sorting into delivery sequence items of mail destined for address/delivery points within a predetermined delivery area having at least two delivery runs, said sorting arrangement comprising:

an input means for successively feeding into said sorting arrangement said items of mail carrying address information;

a reading means for reading said address information on said items of mail;

a control means for analyzing said address information read from said items of mail and for allocating a sequence indication to the items of mail involved; and a number of similar deposit devices with sequence numbers 1, 2, . . . , n for depositing and receiving items of mail therein, said deposit devices comprising removable bins that are removed from said sorting arrangement upon completion of a sorting operation;

first sorting means for performing a first sorting run for feeding items of mail to said input means, for reading, with said reading means, said address information on said items of mail, for allocating, with said control means, to each said item of mail a sequence indication based on the address information read, wherein each said sequence indication comprises a pair of numbers (j,k), with a first number j=1, 2, . . . , n and a second number k=1, 2, . . . , n, said allocated pairs of numbers forming matrix positions in an (n×n) matrix, each said matrix position corresponding with an address/delivery point in a delivery run within said delivery area, and said matrix positions being grouped per delivery run in non-overlapping (p×q) submatrices of the (n×n) matrix, the number j corresponding with the first number of said allocated pairs of numbers, and for sorting the items of mail for at least two delivery runs during said first sorting run, and for depositing each said item of mail in a deposit device with a first sequence number derived from said sequence indication allocated to the item of mail involved;

second sorting means for performing a second sorting run for taking the items of mail deposited during said first sorting run from said deposit devices with sequence numbers 1, 2, . . . , n, and feeding said items of mail taken from said deposit devices to said input means, and for depositing each said item of mail in a deposit device with a second sequence number derived from the sequence indication allocated to the item of mail involved, wherein said second sequence number corresponds with said second number k of said pairs of numbers, and during each said second sorting run, for each delivery run i with p×q address/delivery points, q of the n deposit devices of said sorting arrangement where (n>q>1) for depositing said items of mail for the first p address/delivery points of the delivery run, forming the first delivery segment of the delivery run, in delivery point sequence in the first of the q deposit devices, and for depositing the items of mail for the second p address/delivery points, forming the second delivery segment of the delivery run, in delivery point sequence in the second of the q deposit devices, and so forth until the items of mail for all p×q deposit devices allocated to them;

bundling means for bundling said items of mail from the successive deposit devices while maintaining the order in which said items of mail were deposited, and for bundling said items of mail, of a certain delivery run, from said deposit devices in succession according to the numbers k corresponding to the delivery run, in number sequence;

first signal means for generating a segment-end signal suitable for human perception following said second sorting means reaching a last dummy address/delivery point of a delivery segment, said first signal means including means for generating said segment-end signal until the corresponding bin has been removed from said sorting arrangement and an empty bin is put in its place, and manual terminating means for enabling manual termination of said segment-end signal after a corresponding bin has been removed and replaced with an empty bin; and wherein said control means includes means for choosing the value of q, for each delivery run i, as a function of the number of address/delivery points of said delivery run i.

6. A sorting arrangement according to claim 5, further including a second signal means for generating an empty-bin-present signal, and an auto-terminating means for terminating said segment-end signal in response to an empty-bin-present signal generated after the corresponding bin has been removed and replaced with an empty bin.

7. A method for sorting into delivery sequence items of mail destined for address/delivery points within a predetermined delivery area comprising at least two delivery runs by means of a sorting arrangement, said sorting arrangement comprising:

an input means for successively feeding into said sorting arrangement said items of mail carrying address information;

a reading means for reading said address information on said items of mail;

a control means for analyzing said address information read from said items of mail and for allocating a sequence indication to the items of mail involved; and a number of similar deposit devices with sequence numbers 1, 2, . . . , n for depositing and receiving items of mail therein;

said method comprising:

(a) a first sorting run comprising the following steps:

feeding items of mail to said input means;

reading, with said reading means, said address information on said items of mail;

allocating, with said control means, to each said item of mail a sequence indication based on the address information read, wherein each said sequence indication comprises a pair of numbers (j,k), with a first number j=1, 2, . . . , n and a second number k=1, 2, . . . , n, said allocated pairs of numbers forming matrix positions in an (n×n) matrix, each said matrix position corresponding with an address/delivery point in said at least two delivery runs within said delivery area, and said matrix positions being grouped per delivery run in non-overlapping (p×q) submatrices of the (n×n) matrix, the number j corresponding with the first number of said allocated pairs of numbers; and sorting said items of mail for said at least two delivery runs during said first sorting run by depositing each said item of mail in a deposit device with a first sequence number derived from said sequence indication allocated to the corresponding item of mail;

(b) a second sorting run comprising the following steps:

taking the items of mail deposited during said first sorting run from said deposit devices with sequence numbers 1, 2, . . . , n;

feeding said items of mail taken from said deposit devices in the previous step to said input means; and depositing each said item of mail in a deposit device with a second sequence number derived from the sequence indication allocated to the corresponding item of mail, wherein said second sequence number corresponds with said second number k of said pairs of numbers, and during each said second sorting run, for each delivery run i with p×q address/delivery points, q of the n deposit devices of said sorting arrangement where (n>q>1) deposit said items of mail for the first p address/delivery points of the delivery run, forming the first delivery segment of a delivery run, in delivery point sequence in the first of the q deposit devices, and that the items of mail for the second p address/delivery points, forming the second delivery segment of a delivery run, are deposited in delivery point sequence in the second of the q deposit devices, and so forth until the items of mail for all p×q delivery points of delivery run i have been deposited in the deposit devices allocated to them; and (c) a bundling stage comprising the following steps:

bundling said items of mail from the successive deposit devices while maintaining the order in which said items of mail were deposited; and during each said bundling stage, for a certain delivery run, bundling said items of mail from said deposit devices in succession according to the numbers k corresponding to each said at least two delivery runs, in number sequence.

8. A method according to claim 7, wherein said step of depositing each said item of mail in a deposit device during said second sorting run comprises the step of choosing the value of q, for each delivery run i, as a function of the number of address/delivery points of said delivery run i.

9. A method according to claim 7, wherein said deposit devices comprise bins placed in said sorting arrangement and further including the step of removing said bins from said sorting arrangement upon completion of a sorting operation.

10. A method according to claim 9, further including generating a segment-end signal suitable for human perception following said depositing step reaching the last address/delivery point of a delivery segment during a sorting process.

11. A method according to claim 10, wherein said step of generating a segment-end signal comprises generating said segment-end signal until the corresponding bin has been removed from said sorting arrangement and an empty bin is put in its place.

12. A method according to claim 11, further including the step of terminating, through human intervention, said segment-end signal after a corresponding bin has been removed and replaced with an empty bin.

13. A method according to claim 12, further including the step of terminating said segment-end signal in response to an empty-bin-present signal generated within said sorting arrangement after the corresponding bin has been removed and replaced with an empty bin.

14. A method for sorting into delivery sequence items of mail destined for address/delivery points within a predetermined delivery area comprising at least two delivery runs by means of a sorting arrangement, said sorting arrangement comprising:

an input means for successively feeding into said sorting arrangement said items of mail carrying address information;

a reading means for reading said address information on said items of mail;

a control means for analyzing said address information read from said items of mail and for allocating a sequence indication to the items of mail involved; and a number of similar deposit devices with sequence numbers 1, 2, . . . , n for depositing and receiving items of mail therein, and wherein each of said deposit devices comprise stackers in which said items of mail are deposited;

said method comprising:

(a) a first sorting run comprising the following steps:

feeding items of mail to said input means; reading, with said reading means, said address information on said items of mail;

allocating, with said control means, to each said item of mail a sequence indication based on the address information read, wherein each said sequence indication comprises a pair of numbers (j,k), with a first number j=1, 2, . . . , n and a second number k=1, 2, . . . , n, said allocated pairs of numbers forming matrix positions in an (n×n) matrix, each said matrix position corresponding with an address/delivery point in a delivery run within said delivery area, and said matrix positions being grouped per delivery run in non-overlapping (p×q) submatrices of the (n×n) matrix, the number j corresponding with the first number of said allocated pairs of numbers, and sorting the items of mail for at least two delivery runs during said first sorting run; and depositing each said item of mail in a deposit device with a first sequence number derived from said sequence indication allocated to the item of mail involved;

(b) a second sorting run comprising the following steps:

taking the items of mail deposited during said first sorting run from said deposit devices with sequence numbers 1, 2, . . . , n;

feeding said items of mail taken from said deposit devices in the previous step to said input means; and depositing each said item of mail in a deposit device with a second sequence number derived from the sequence indication allocated to the item of mail involved, wherein said second sequence number corresponds with said second number k of said pairs of numbers, and during each said second sorting run, for each delivery run i with p×q address/delivery points, q of the n deposit devices of said sorting arrangement where (n>q>1) deposit said items of mail for the first p address/delivery points of a delivery run, forming the first delivery segment of a delivery run, in delivery point sequence in the first of the q deposit devices, and that the items of mail for the second p address/delivery points, forming the second delivery segment of a delivery run, are deposited in delivery point sequence in the second of the q deposit devices, and so forth until the items of mail for all p×q delivery points have been deposited in the deposit devices allocated to them; and (c) a bundling stage comprising the following steps:

bundling said items of mail from the successive deposit devices while maintaining the order in which said items of mail were deposited; and during each said bundling stage, for a certain delivery run, bundling said items of mail from said deposit devices in succession according to the numbers k corresponding to the delivery run, in number sequence; and further including the step of adding, after the last address/delivery point in the sorting sequence of each delivery segment of a delivery run, at least one dummy address/delivery point for which none of said items of mail are ever deposited in any stacker.

15. A method according to claim 14, further including generating a segment-end signal suitable for human perception when said depositing step reaches a first dummy address/delivery point during a delivery run deposit.

16. A method according to claim 15, wherein said step of generating a segment-end signal comprises generating said segment-end signal until the corresponding stacker has been emptied.

17. A method according to claim 16, further including the step of terminating, by human intervention, said segment-end signal after the corresponding stacker has been emptied.

18. A method according to claim 17, further including the step of terminating said segment-end signal in response to a stacker-empty signal generated within said sorting arrangement after the corresponding stacker has been emptied.

19. A method according to claim 16, further including the step of stopping, when said segment-end signal is not terminated within a predetermined time, said sorting arrangement as soon as it is detected that said sorting arrangement contains an item of mail for a subsequent delivery run to be sorted in the group of q corresponding stackers.

* * * * *